US006975232B1

(12) United States Patent
McKenna

(10) Patent No.: US 6,975,232 B1
(45) Date of Patent: Dec. 13, 2005

(54) APPARATUS AND METHOD FOR "SEEING" FOOT INSIDE OF SHOE TO DETERMINE THE PROPER FIT OF THE SHOE

(76) Inventor: Lou McKenna, 2355 Fairview Ave., Roseville, MN (US) 55113

( * ) Notice: Subject to any disclaimer, the term of this patent is extended or adjusted under 35 U.S.C. 154(b) by 60 days.

(21) Appl. No.: 10/384,805

(22) Filed: Mar. 10, 2003

(51) Int. Cl.[7] ..... G08B 23/00

(52) U.S. Cl. ..... 340/573.1; 340/584; 356/601; 378/92; 378/210; 702/152; 702/155

(58) Field of Search ..... 340/573.1, 584, 340/551, 552, 555, 561, 581; 359/398; 600/425, 600/407, 592; 378/1, 2, 42, 46; 356/601, 356/604, 552, 141.1, 141.5; 705/26; 702/155, 702/152; 33/3 R; 374/6, 141

(56) References Cited

U.S. PATENT DOCUMENTS

| | | | | |
|---|---|---|---|---|
| 4,642,454 A | | 2/1987 | Carlson | 250/221 |
| 5,164,793 A | * | 11/1992 | Wofersberger et al. | 356/604 |
| 5,365,237 A | | 11/1994 | Johnson et al. | 342/179 |
| 5,515,268 A | * | 5/1996 | Yoda | 705/26 |
| 5,539,677 A | * | 7/1996 | Smith | 705/26 |
| 5,642,394 A | | 6/1997 | Rothschild | 378/57 |
| 5,675,149 A | | 10/1997 | Wood et al. | 250/332 |
| 5,678,566 A | * | 10/1997 | Dribbon | 600/592 |
| 5,815,410 A | | 9/1998 | Heinke et al. | 364/557 |
| 6,029,358 A | * | 2/2000 | Mathiasmeier et al. | 33/3 R |
| 6,104,840 A | | 8/2000 | Ejiri et al. | 382/284 |
| 6,282,260 B1 | | 8/2001 | Grodzins | 378/87 |
| 6,331,893 B1 | * | 12/2001 | Brown et al. | 356/601 |
| 6,362,832 B1 | | 3/2002 | Stephan et al. | 345/629 |
| 6,366,316 B1 | | 4/2002 | Parulski et al. | 348/239 |
| 6,459,761 B1 | | 10/2002 | Grodzins et al. | 378/57 |
| 6,461,298 B1 | | 10/2002 | Fenster et al. | 600/437 |
| 6,477,230 B1 | | 11/2002 | Fuchs et al. | 378/98 |
| 6,497,511 B1 | | 12/2002 | Schmitt et al. | 378/207 |
| 6,507,024 B2 | | 1/2003 | Stewart | 250/353 |

OTHER PUBLICATIONS

She Fitting X-Ray Device; http://www.mtn.org/quack/devices/shoexray.*

* cited by examiner

*Primary Examiner*—Davetta W. Goins

(57) ABSTRACT

A thermographic infrared apparatus and method for seeing, and thus measuring, a foot inside of a shoe. The apparatus includes one or more thermographic instruments aimed at a base for capturing one or more thermographic images or fields of view of a shoe on the base and thus the heat transferred to the shoe from the foot. The apparatus further includes a display mounted above the base and aimed at the eye level of a person standing on the base such that the person can determine from the thermographic image how well the shoe or shoes fit. The method includes one or more of the steps of taking a thermal infrared image of a shoe on a foot, taking a thermal infrared image of a foot having no shoe thereon, taking a thermal infrared image of a shoe having no foot therein, taking a thermal infrared image from a first direction, taking a thermal infrared image from a second direction to capture surfaces hidden from the first direction, and then comparing one or more of the thermal infrared images. Other imaging methods for determining proper fit of a shoe include low dose x-ray, backscattering x-ray, microwave, acoustic, radio, and ultrasound imaging methods.

23 Claims, 10 Drawing Sheets

APPARATUS AND METHOD FOR "SEEING" FOOT INSIDE OF SHOE TO DETERMINE THE PROPER FIT OF THE SHOE

BACKGROUND OF THE INVENTION

The present invention relates generally to an apparatus and method for determining proper fit of a shoe, particularly to such an apparatus and method utilizing differences in temperature on the outer surface of the shoe, and specifically to such an apparatus and method utilizing infrared thermal infrared apparatus and methods.

Electromagnetic radiation is the emission of energy from a source. The visible portion of the electromagnetic spectrum includes radiation having wavelengths from about 0.38 micrometers to about 0.72 micrometers. The infrared portion of the electromagnetic spectrum includes radiation having wavelengths from about one micrometer to about 1000 micrometers.

The infrared portion of the electromagnetic spectrum is further divided into two sections, the near infrared section and the thermal infrared section. The near infrared section includes radiation having wavelengths from about one micrometer to about four micrometers. Near infrared radiation is the part of the infrared portion closest to the visible light portion of the electromagnetic spectrum. Like visible light radiation, near infrared radiation is emitted from the sun (or another source) and is reflected by an object. Near infrared instruments capture this reflected radiation, not thermal infrared radiation emitted from such object.

The thermal infrared section of the electromagnetic spectrum includes radiation having wavelengths from about four micrometers to about 1000 micrometers. The present invention relates to the thermal infrared section of the infrared portion of the electromagnetic spectrum.

Thermal infrared radiation is emitted from almost any source, whether the source is a gas, liquid or solid, providing the source is above a minus 273 degrees Celsius (absolute zero). Conventional thermographic instruments can perceive infrared radiation from sources that are about a minus 35 degrees Celsius or higher.

Thermal infrared radiation is emitted from about the first one-onethousandths of an inch of the source. Thermal infrared instruments do not see through objects James Bond style. Instead, via a thermal infrared instrument, one sees temperature or thermal patterns on the surface of the object.

A thermographic infrared instrument is similar to a conventional camera. The typical thermographic instrument includes an optical means that includes a lens that is transparent to thermal infrared radiation. The lens is opaque to visible light. The optical means mounted in the instrument directs the radiation emitted from the object, such as a shoe, to an infrared detector mounted in the instrument. The infrared detector itself may include a thermopile detector consisting of a plurality of thermocouple junctions connected in series and arranged in a radial pattern. The infrared detector conventionally includes a filter that permits the section of the infrared spectrum of interest to pass (typically, for example, from about eight micrometers to about 14 micrometers). A heat sink may be mounted on or about the infrared detector, though noncooled thermal detectors are available. The thermal infrared instrument may further include temperature sensors, such as a temperature sensor for determining ambient temperature and a temperature sensor on a "flag" that moves into and out of the incoming radiation such that the detector alternately receives radiation from the target and from the flag. The thermal infrared instrument further conventionally includes a processor for processing signals from the detector and temperature sensors to determine the temperature of the target.

An infrared thermographic camera may include a linear thermoelectric array. Such an array is fabricated using silicon microstructure processing and is composed of 120 pixels arranged in a row. By moving this linear array of detectors, a two-dimensional image is produced.

The picking and sizing of shoes is problematic and subjective. For example, a shoe customer having a size eight and one-half foot may fit into a size nine shoe in a first brand and may fit into a size eight shoe in a second brand. However, as to the first brand, the customer may also fit into a size eight and one-half shoe. Likewise, with the second brand, the customer may fit into a size eight and one-half shoe. Which of the four shoes is the best fit?

Using the sense of touch, the customer feels for her big toe. Using the sense of touch, the customer walks around the store in one size of shoe in one brand, then in another size of shoe in the same brand, then in one size of shoe in a different brand, and then in another size shoe in such different brand. She then may decide that none of the four pairs of shoes is just right and begins the process anew at the same store or at another store.

Compounding the above noted problems, shoe manufacturers may make one brand of shoe in one region or one country in one year and then may make the same brand of shoe in another region or another country in another year. As the manufacturing sites change, so does the equipment and personnel. So too do the sizes of the shoes within the same brand change, even if the "size" of the shoe is American size eight for women. In other words, within the shoe industry, there is no such thing as an "exact size" even for two otherwise identical pairs of shoes being displayed next to each other on the shelf of a shoe store at the same time because one pair may have been manufactured in Italy and the other pair may have been manufactured in the United States.

The present invention offers an apparatus and method for the customer to evaluate the fit of a shoe on the spot by permitting the customer to "see" her foot inside of the new shoe by thermal infrared imaging or by another means of imaging.

SUMMARY OF THE INVENTION

A feature of the present invention is the provision in a method for determining proper fit of a shoe, of the step of taking a first thermal infrared image of a shoe on a foot.

Another feature of the present invention is the provision in a method for determining proper fit of a shoe, of the step of taking a second thermal infrared image of a foot having no shoe thereon.

Another feature of the present invention is the provision in a method for determining proper fit of a shoe, of the step of taking a third thermal infrared image of a shoe having no foot therein.

Another feature of the present invention is the provision in a method for determining proper fit of a shoe, of comparing two or more of the first, second, and third thermal infrared images.

Another feature of the present invention is the provision in a method for determining proper fit of a shoe, of taking a first thermal infrared image from a first direction of a shoe on a foot and taking a second thermal infrared image from a second direction of the shoe on the foot to capture surfaces of the shoe hidden from the first thermal infrared image.

Another feature of the present invention is the provision in a method for determining proper fit of a shoe, of the step of taking thermal infrared images from one or more of directions from the top of the shoe, the front end of the shoe, the rear end of the shoe, the right side of the shoe, the left side of the shoe, and the sole of the shoe.

Another feature of the present invention is the provision in a thermal infrared apparatus for the perception of a foot inside of a shoe for determining proper fit of the shoe, of the apparatus having a base upon which the shoe is placed, a thermal infrared instrument aimable at the base, and a display aimable at a person wearing the shoe that is placed on the base and displaying thermal infrared patterns captured by the thermal infrared instrument.

Another feature of the present invention is the provision in such a thermal infrared apparatus, of the thermal infrared instrument including two fields of view, wherein one of the fields of view captures a view of a foot from one direction and wherein the other of the fields of view captures a view of the foot from another direction whereby surfaces hidden from one of the views may be captured by the other of the views.

Another feature of the present invention is the provision in a method of determining the proper fit of a shoe, of the steps of perceiving a position of a foot in a shoe and taking an image of such perception, digitally processing the image, and displaying the image.

Another feature of the present invention is the provision in a method of determining the proper fit of a shoe, of perceiving a position of a foot in a shoe by one or more of infrared thermographic imaging, low dose x-ray imaging, backscattering x-ray imaging, microwave imaging, acoustic imaging, radio imaging, and ultrasound imaging.

An advantage of the present invention is that the proper fit of a shoe may be determined.

Another advantage of the present invention is that the proper fit of a shoe may be determined while the shoe is on the foot.

Another advantage of the present invention is that the proper fit of a shoe may be determined using the sense of sight rather than the sense of touch, such as by using the thumb to determine the position of the big toe or by using the sense of touch in the foot itself.

Another advantage of the present invention is that the proper fit of a shoe may be determined using the actual shoe that will be worn, instead of waiting over a period of time for a customized shoe to be manufactured.

Another advantage of the present invention is that the present thermographic infrared apparatus is computer based.

Another advantage of the present invention is that images, however taken, are digitally processed and displayed.

Another advantage of the present invention is that the present thermographic infrared apparatus produces little or no waste such as photographic film.

Another advantage of the present invention is that the present thermographic infrared apparatus is relatively inexpensive to build, operate and maintain. The thermographic infrared apparatus may be used repeatedly with little or no maintenance.

Another advantage of the present invention is that the present thermographic infrared apparatus minimizes the return of shoes that do not fit and therefore is fiscally self-supporting.

Other and further features and advantages of the present invention will become apparent to those skilled in the art upon a review of the accompanying specification and drawings.

IN THE DRAWINGS

DESCRIPTION OF THE PREFERRED EMBODIMENT

Thermographic Infrared Apparatus 10

Figure 1:
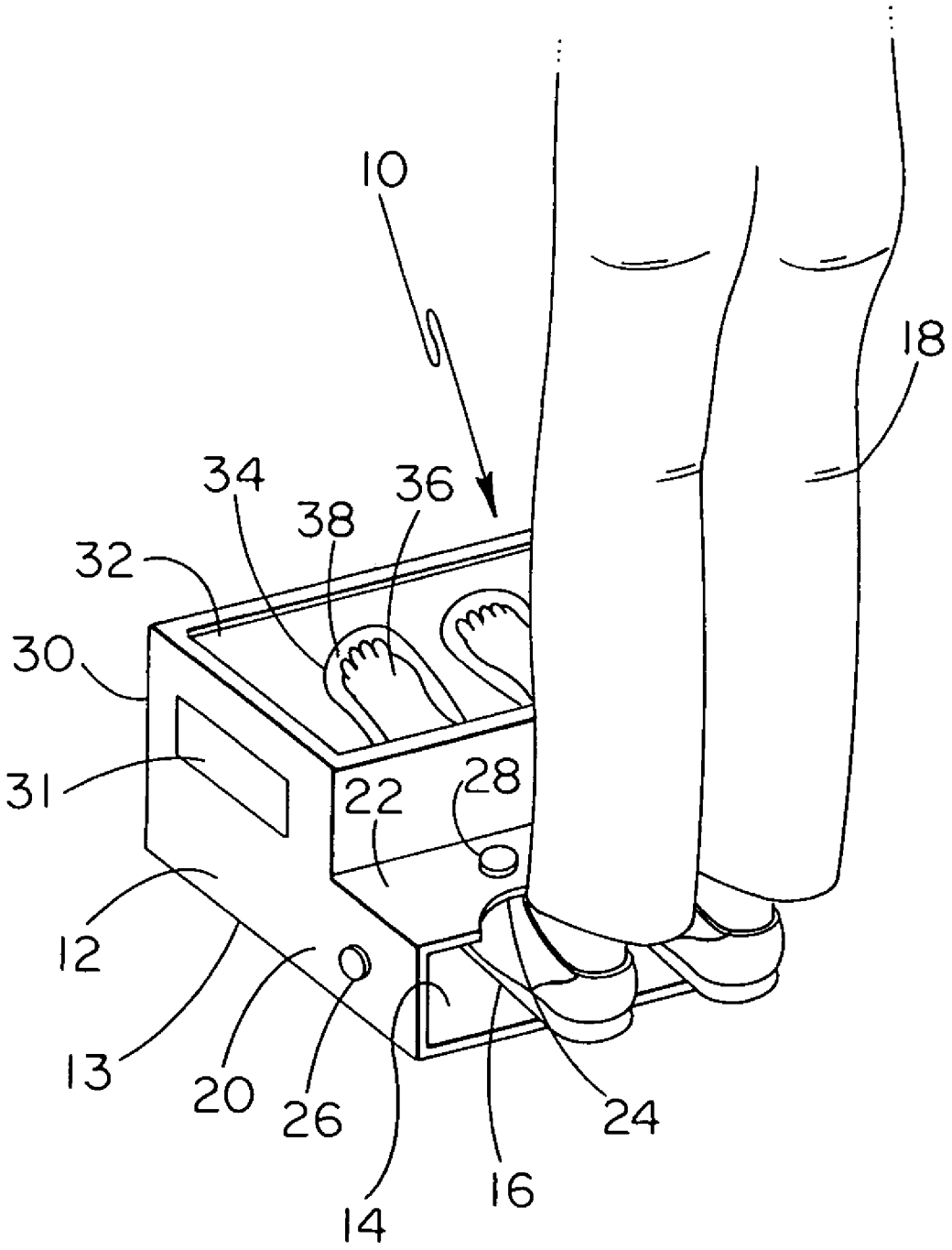
FIG. 1 is a diagrammatic view of one embodiment of the thermographic infrared apparatus of the present invention.

In accordance with the preferred embodiment of the present invention, as shown in FIG. 1, the present thermographic infrared apparatus or imaging radiometer is indicated in general by reference number 10. The thermographic infrared apparatus 10 includes a housing 12. Housing 12 includes a first portion 13 having a base or floor 14 adapted for the shoes 16 being worn by a person 18. The first portion 13 of the housing 12 further is defined by a pair of sides 20 and a ceiling or upper shroud 22 running to and between the sides 20 and being disposed opposite of the base or floor 14. The ceiling 22 includes a pair of curved recesses 24 formed therein where each of the recesses 24 may include an ankle or shin of a leg of person 18. Each of the sides 20 has engaged thereto a thermographic infrared instrument 26 for capturing a view of a side of a shoe being worn by person 18. The ceiling 22 has engaged thereto a thermographic infrared instrument 28 for capturing a view of a top of a shoe being worn by person 18. Housing portion 13 may have further thermographic infrared instruments mounted below the base 14, such as when the base 14 is a rigid wire platform to permit infrared radiation to pass through openings in the wire. Housing portion 13 may further have a front end running to and between the sides 20 and at a right angle to base 14 and ceiling 22 and a pair of thermographic instruments mounted therein so as to capture front end view of right and left shoes 16.

Housing 12 includes a second portion 30 having a computer processor 31 and a display or monitor 32. The display 32 is adjustable so as to be aimed at generally the eye level of an adult or child wearing the shoes that are placed in the first housing portion 13. Information, such as digital information, from one or more of the thermographic infrared instruments 26, 28 is fed, such as through a wired or wireless system, into the computer processor 31. The computer processor 31 processes such information and sends such processed information to the monitor 32. The monitor 32 is shown displaying a computer enhanced infrared image 34 of a perimeter of the shoe upper of the left shoe 16, a computer enhanced infrared image 36 of the left foot of the person 18, and a computer enhanced infrared image 38 of spaces between perimeter of the shoe upper and the left foot. FIG. 1 also shows portions of the computer enhanced infrared images of the right shoe, right foot, and spaces therebetween.

Thermographic Infrared Apparatus 40

Figure 2:
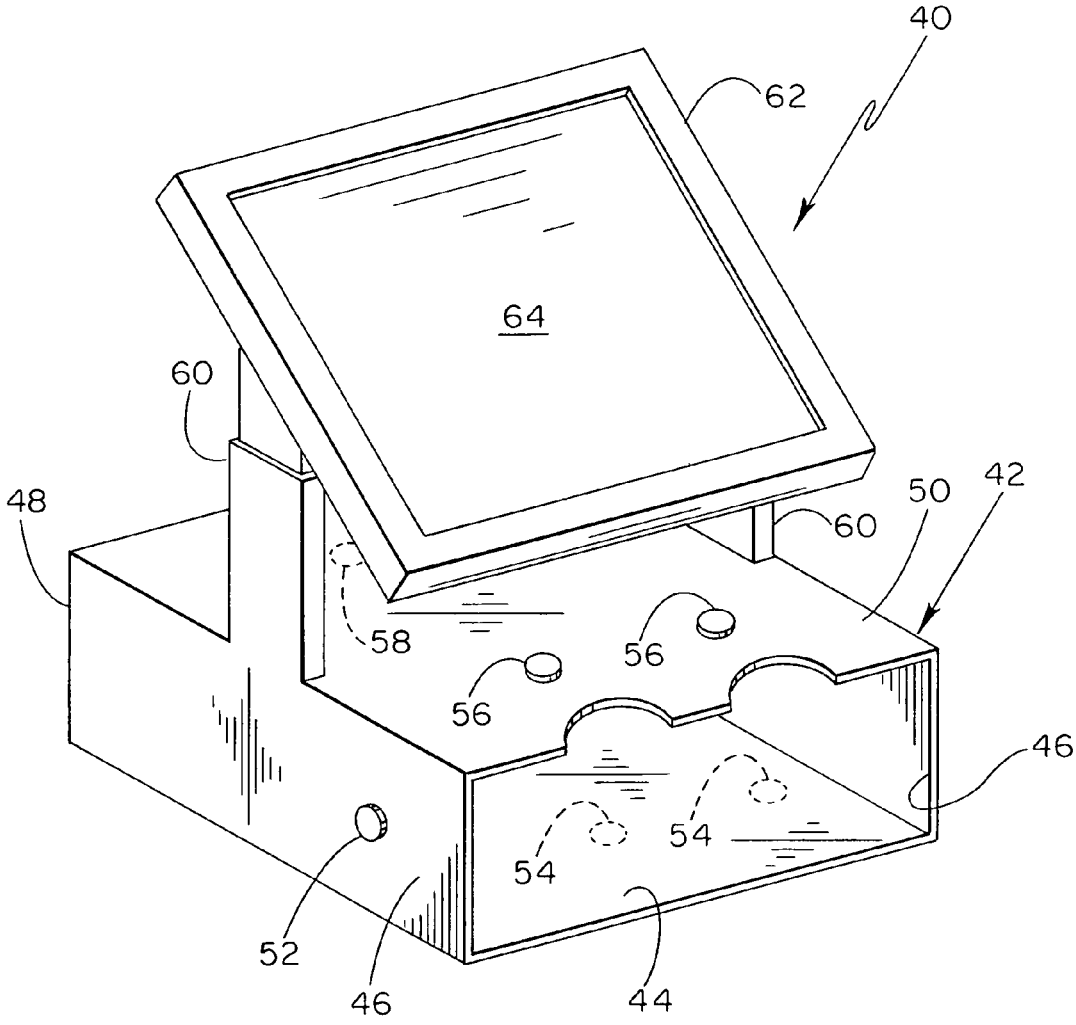
FIG. 2 is a diagrammatic view of another embodiment of the thermographic infrared apparatus of the present invention.

FIG. 2 shows another thermographic infrared apparatus or imaging radiometer 40 of the present invention having a housing 42. Housing 42 includes a base or floor 44, a pair of sides 46, and a front end 48, and a ceiling 50. One thermographic instrument 52 is mounted on the left side 46 to capture a view of the left side of the left shoe. A pair of thermographic instruments 54 are mounted to housing 42 below the base 44 to capture respective views of the soles of the right and left shoe. A pair of thermographic infrared instruments 56 are mounted to the ceiling 50 to capture respective views of the top of the right and left shoes. A pair of thermographic infrared instruments 58 are mounted on the front end 48 to capture respective views of the front ends of the right and left shoes. Curved recesses 60 are formed in ceiling 50 for reception of the ankles or shins of the legs of the person wearing the shoes to be placed on base 44. Curved recesses 60 are aligned with respective thermographic infrared instruments 56, are further aligned with respective thermographic infrared instruments 54, and are still further aligned with thermographic infrared instruments 58 such that the shoes are centered in the fields of view of such instruments. Thermographic infrared instruments 52 are aligned with thermographic infrared instruments 56 such that the axis of the fields of view of side mounted instruments 52 extend laterally into the sides of the shoes.

Mounted to housing 42 via arms 60 is a processor 62 having a flat screen display 64. Arms 60 are adjustable such that the display 64 may be aimable at the eye level of a child or an adult. As with the embodiment of FIG. 1, the thermographic infrared instruments 52, 54, 56, 58 capture thermographic infrared images of the shoes from different directions and send such information, such as digital information via a wired or wireless system, to the processor 62. In turn, processor 62 processes such information and displays such information on the display 64.

Thermographic Infrared Apparatus 70

Figure 3:
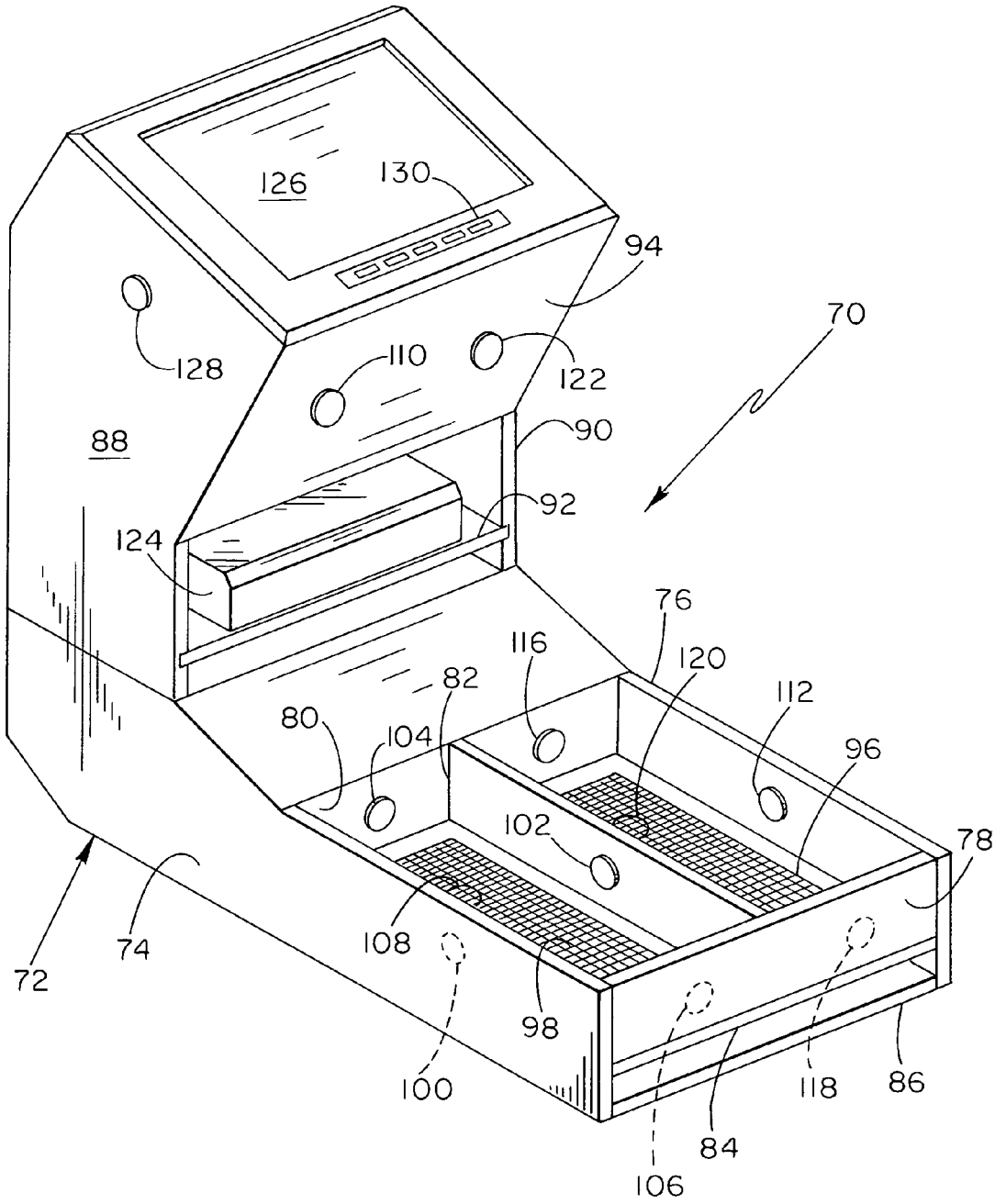
FIG. 3 is a perspective view of another embodiment of the thermographic infrared apparatus of the present invention.

FIG. 3 shows a thermographic infrared apparatus or imaging radiometer 70 of the present invention having a housing 72. Housing 72 includes a first lower side panel 74, a second lower side panel 76, a rear end panel 78 running to and between the side panels 74, 76, a front end panel 80 running to and between the side panels 74, 76, a center panel 82 medial of the side panels 74, 76 and running to and between the rear end panel 78 and the front end panel 80, an upper base or floor panel 84 running to and between the side panels 74, 76, and a lower base or floor panel 86 disposed parallel to the first base panel 84 and running to and between the side panels 74, 76. Housing 72 further includes a first upper side panel 88, a second upper side panel 90, a shelf 92 running to and between upper side panels 88, 90, and an oblique panel 94 running to and between the upper side panels 88, 90.

Upper base panels 84 have locations 96, 98 for the placement of right and left shoes. Locations 96, 98 are rectangular platforms of rigid wire mounted in openings formed in upper base panels 84. The rigid wire permits thermal infrared radiation to pass therethrough. Such thermal infrared radiation emanates from the soles of the shoes and any portions of the shoe uppers extending beyond the sides of the soles of the shoes.

Side panel 74 includes a thermal infrared instrument 100 having a field of view directed at the left side of the left shoe. In other words, this field of view has an axis originating from an area left of the location for the left shoe and generally extending laterally across the location for the left shoe.

Figure 4A:
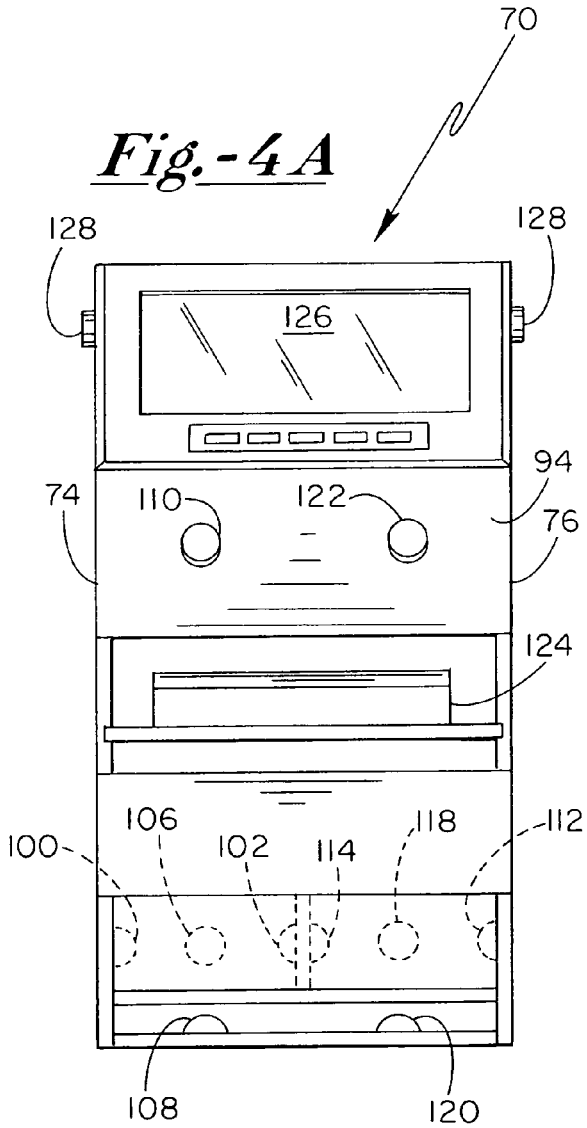
FIG. 4A is a front plan partially phantom view of the thermographic infrared apparatus of FIG. 3.
Figure 4B:
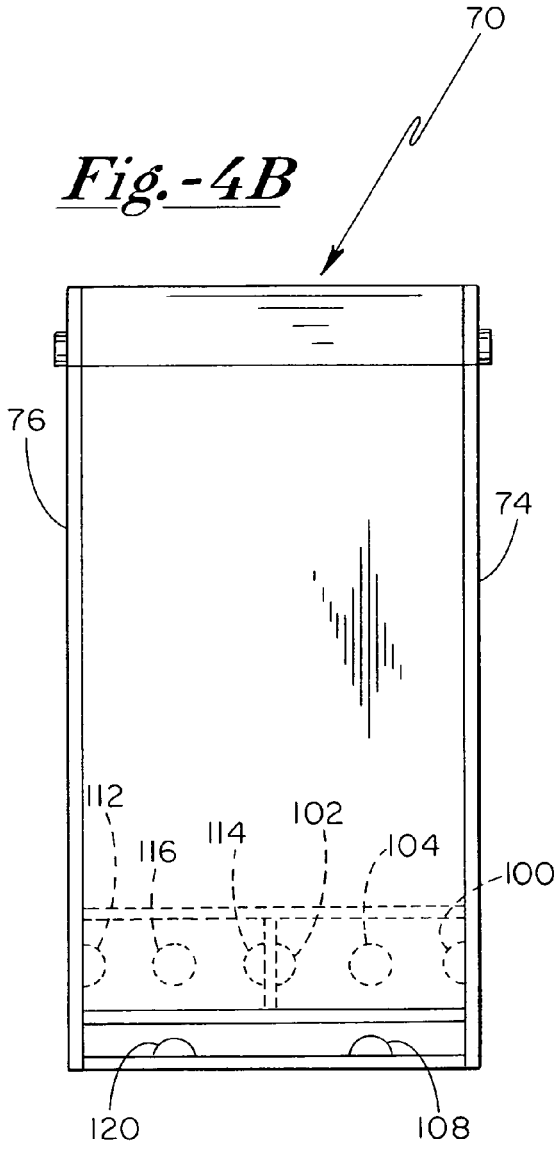
FIG. 4B is a rear plan partially phantom view of the thermographic infrared apparatus of FIG. 3.
Figure 5A:
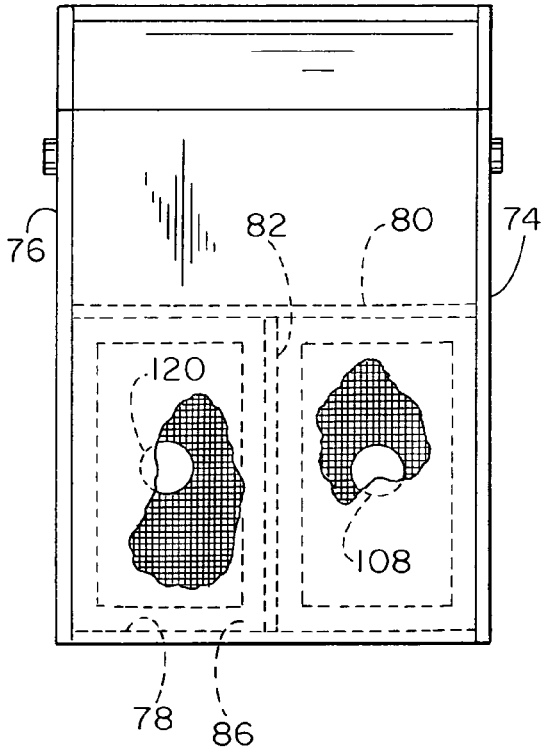
FIG. 5A is a bottom plan partially cut-away view of the thermographic infrared apparatus of FIG. 3.
Figure 5B:
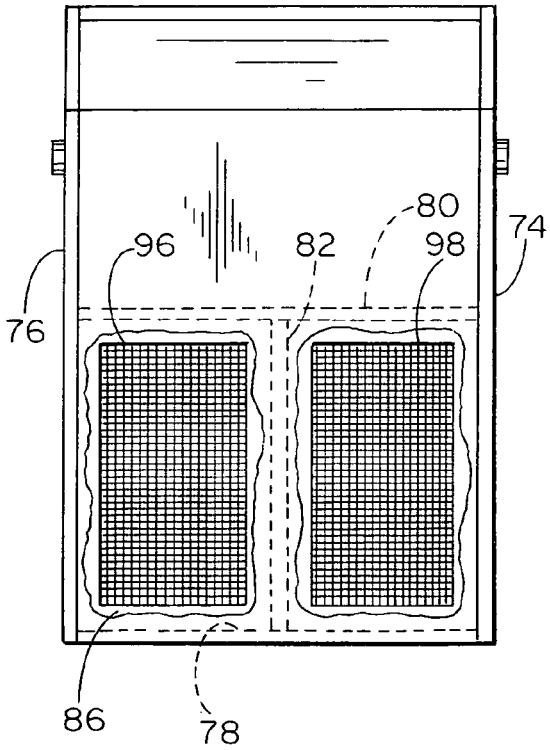
FIG. 5B is a bottom plan partially cut-away view of the thermographic infrared apparatus of FIG. 3.

Center panel 82 includes a thermal infrared instrument 102 having a field of view directed at the right side of the left shoe, as shown in FIGS. 4A and 4B. In other words, this field of view has an axis originating from an area right of the location for the left shoe and generally extending laterally across the location for the left shoe.

Front end panel 80 includes a thermal infrared instrument 104 having a field of view directed at the front end of the left shoe. In other words, this field of view has an axis originating from an area in front of the location for the left shoe and generally extending longitudinally across the location for the left shoe.

Rear end panel 78 includes a thermal infrared instrument 106 having a field of view directed at the rear end of the left shoe. In other words, this field of view has an axis originating from an area rearwardly of the location for the left shoe and generally extending longitudinally across the location for the left shoe.

Lower base panel 86 includes a thermographic infrared instrument 108 having a field of view directed at the sole of a shoe placed on rigid wire platform 98. In other words, this field of view has an axis originating from an area below the location for the left shoe and generally extending at a right angle upwardly through location for the left shoe.

Oblique panel 94 includes a thermographic infrared instrument 110 having a field of view directed at the top of a shoe placed on rigid wire platform 98. In other words, this field of view has an axis originating from an area upwardly of and in front of the location for the left shoe and generally extending at an oblique angle downwardly through the location for the left shoe, which axis is generally coplanar with the axis of the field of views provided by thermographic infrared instruments 104 and 106.

Figure 7A:
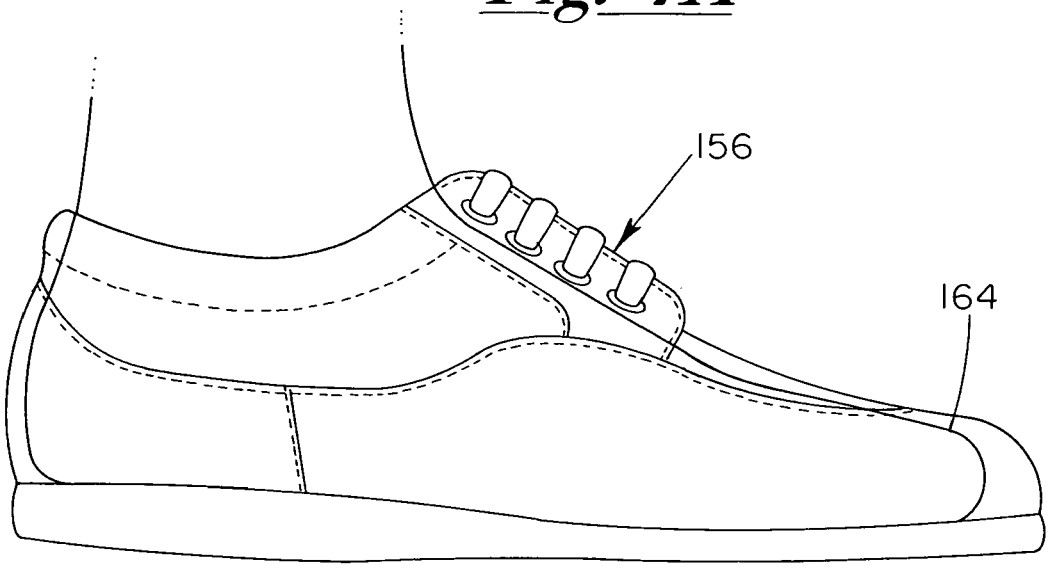
FIG. 7A is a thermographic infrared computer enhanced image of the right side of a right shoe on a right foot, where the image was captured by the thermographic infrared apparatus of FIG. 3.

Side panel 76 includes a thermal infrared instrument 100 having a field of view directed at the right side of the right shoe. In other words, this field of view has an axis originating from an area right of the location for the right shoe and generally extending laterally across the location for the right shoe. This field of view captures an image such as the image shown in FIG. 7A.

Figure 7B:
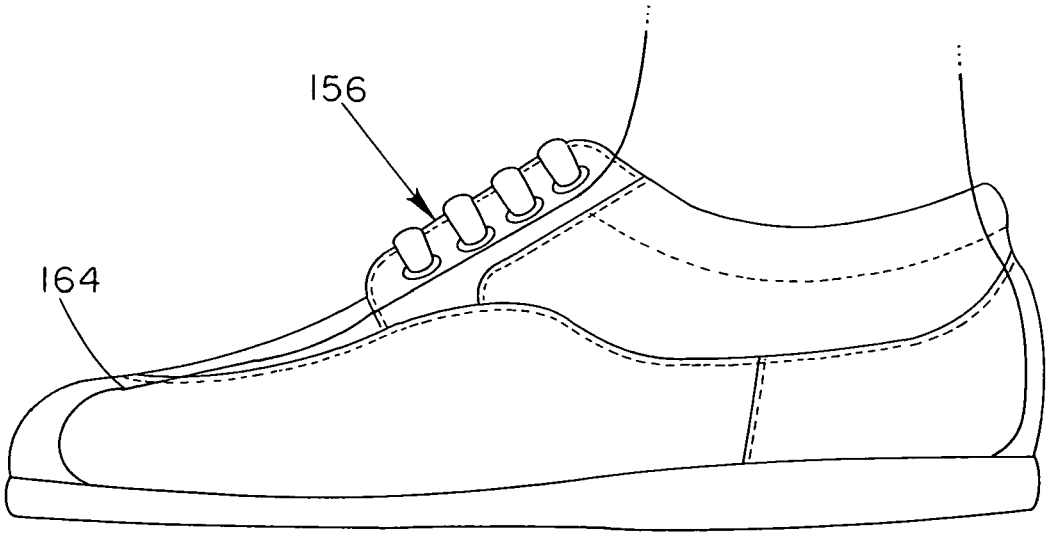
FIG. 7B is a thermographic infrared computer enhanced image of the left side of a right shoe on a right foot of FIG. 7A, where the image was captured by the thermographic infrared apparatus of FIG. 3.

Center panel 82 includes a thermal infrared instrument 114 having a field of view directed at the left side of the right shoe, as shown in FIGS. 4A and 4B. In other words, this field of view has an axis originating from an area left of the location for the right shoe and generally extending laterally across the location for the right shoe. This field of view captures an image such as the image shown in FIG. 7B.

Figure 9A:
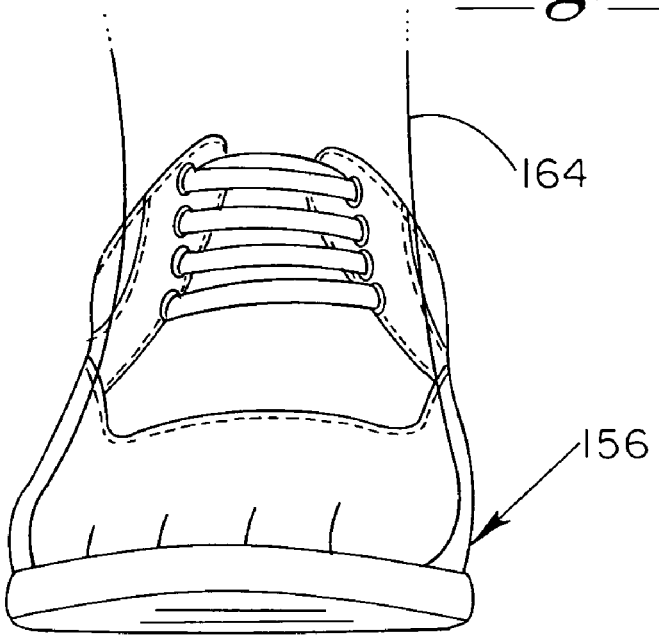
FIG. 9A is a thermographic infrared computer enhanced image of the front end of the right shoe on the right foot of FIG. 7A, where the image was captured by the thermographic infrared apparatus of FIG. 3.

Front end panel 80 includes a thermal infrared instrument 116 having a field of view directed at the front end of the right shoe. In other words, this field of view has an axis originating from an area in front of the location for the right shoe and generally extending longitudinally across the location for the right shoe. This field of view captures an image such as the image shown in FIG. 9A.

Figure 9B:
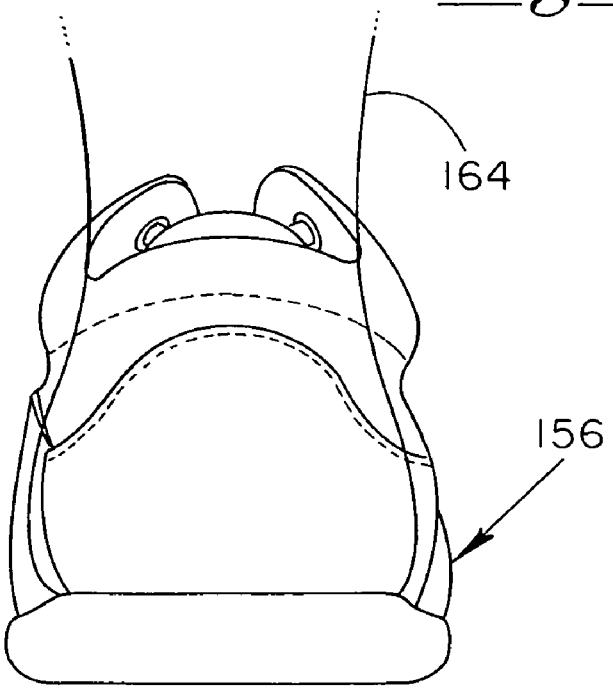
FIG. 9B is a thermographic infrared computer enhanced image of the rear end of the right shoe on the right foot of FIG. 7A, where the image was captured by the thermographic infrared apparatus of FIG. 3.

Rear end panel 78 includes a thermal infrared instrument 118 having a field of view directed at the rear end of the right shoe. In other words, this field of view has an axis originating from an area rearwardly of the location for the right shoe and generally extending longitudinally across the location for the right shoe. This field of view captures an image such as the image shown in FIG. 9B, except for the portion of the image frontwardly of the ankle, which portion of the image is provided by the computer.

Lower base panel 86 includes a thermographic infrared instrument 120 having a field of view directed at the sole of a shoe placed on rigid wire platform 96. In other words, this field of view has an axis originating from an area below the location for the right shoe and generally extending at a right angle upwardly through location for the right shoe. This field of view captures an image such as the image shown in FIG. 8A, except that the rear portion of the image, such as the portion of the image rearwardly of the tongue of the shoe, is provided by computer enhancement.

Oblique panel 94 includes a thermographic infrared instrument 122 having a field of view directed at the top of a shoe placed on rigid wire platform 96. In other words, this field of view has an axis originating from an area upwardly of and in front of the location for the right shoe and generally extending at an oblique angle downwardly through the location for the right shoe, which axis is generally coplanar with the axis of the field of views provided by thermographic infrared instruments 116 and 118. This field of view captures an image such as the image shown in FIG. 8B.

Thermographic infrared apparatus 70 further includes a computer processor 124 on shelf 92 and a display or monitor 126 sandwiched between side panels 88, 90 and pivotally mounted thereto via pivot mechanisms 128 such that the display 126 can be aimed at a child or adult standing on locations 96, 98. A set of controls 130 can operate 1) one or more of the thermographic instruments 100, 102, 104, 106, 108, 110, 112, 114, 116, 118, 120, and 122, 2) the computer processor 124 and 3) the display 126. The thermographic instruments provide image information, such as digital information via a wired or wireless system, to the computer processor 124. The computer processor 124 processes the information and sends such information to the display 126 that can be aimed at the person standing in the locations 96, 98.

Factors that Contribute to Temperature Differences on the Outside of a Shoe

Figure 6A:
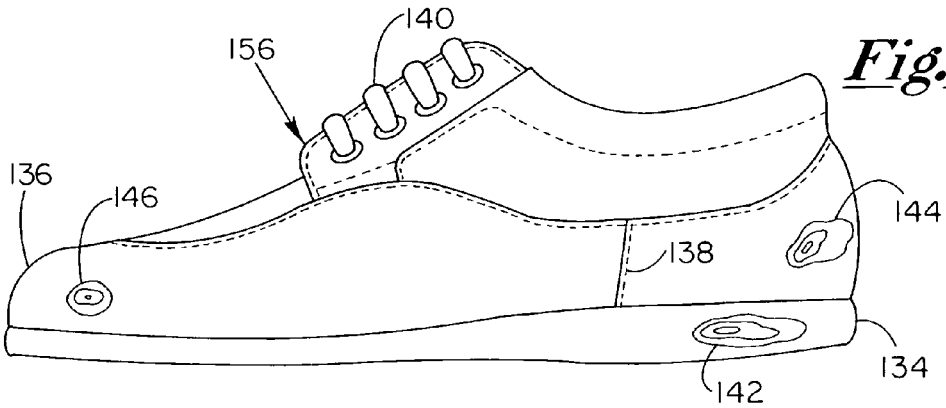
FIG. 6A is a thermographic infrared computer enhanced image of a shoe captured by the thermographic infrared apparatus of FIG. 3.
Figure 6B:
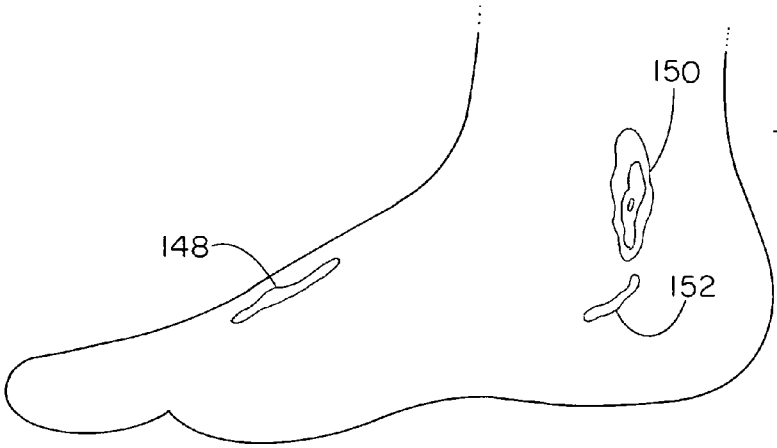
FIG. 6B is a thermographic infrared computer enhanced image of a bare foot captured by the thermographic infrared apparatus of FIG. 3.

The present invention includes a number of methods for determining the proper fit of a shoe. Prior to a discussion of such methods, however, it may be helpful to discuss a number of factors that contribute to temperature differences on the outside of a shoe. A shoe taken from a shoe box or display stand is generally at ambient temperature. However, a shoe is made up of different materials, each of which is likely to be at a slightly different temperature. For example, as shown in FIG. 6A, each of the following parts of a shoe includes a surface having a temperature likely different from the other parts even though the shoe as a whole is in an environment such as a shoe box at ambient temperature: the sole 134, the shoe upper 136, stitching 138, shoe laces 140. Further, variations in surface temperature may occur on one part of the shoe, even though such one part is formed of the same material. These variations in temperature may occur from the shoe being handled, from these parts of the shoe being rubbed against objects, from sunlight or lamps, or from some other cause. These variations in temperature are represented by spectrum 142 on the sole 134 and spectrums 144 and 146 on the shoe upper 136. FIG. 6B shows an infrared image of a left side of a bare right foot. As a foot is placed into the shoe, some inner surfaces of the shoe may warm up more quickly than other inner surfaces of the shoe. Some inner surfaces of the shoe that may warm up more quickly than other inner surfaces are those inner surfaces that more closely confront the foot. Such inner surfaces may frictionally confront the foot. Such a friction fit may or may not be desired. Other inner surfaces of the shoe that may warm up more quickly than other inner surfaces are those inner surfaces next to relatively warm portions of the foot. Those portions of the foot that are relatively warm may be those portions of the foot having a greater amount of arteries, as shown by spectrums 148, 150 and 152 in FIG. 6B. As inner surfaces of the shoe warm up, their respective outer surfaces warm up. It is these outer surfaces that emanate the thermal infrared radiation that is captured by the present thermographic instruments.

Figure 6C:
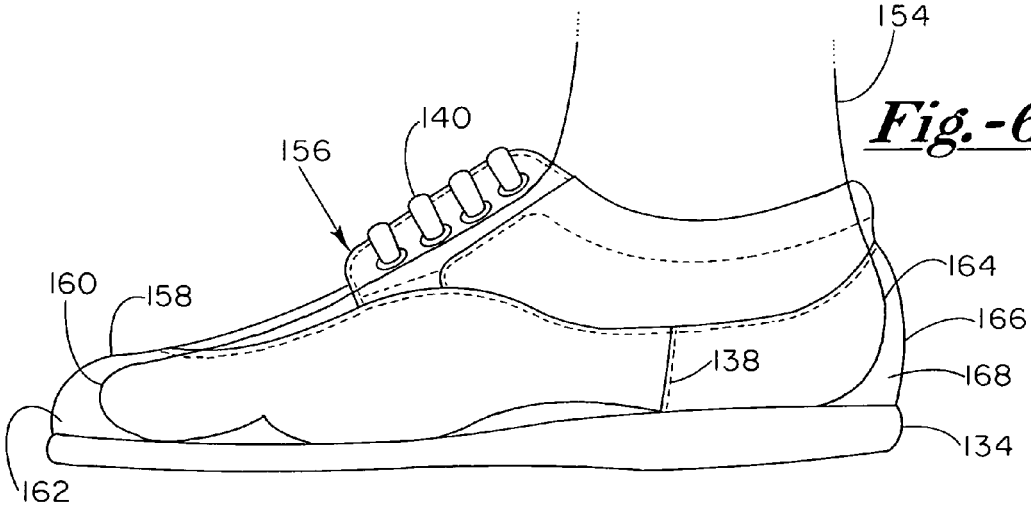
FIG. 6C is a thermographic infrared computer enhanced image of a shoe on a foot captured by the thermographic infrared apparatus of FIG. 3.

The Method for Determining the Proper Fit of a Shoe by the Step of Taking a Thermal Infrared Image of a Shoe on a Foot One method for determining the proper fit of a shoe is the step of taking a thermal infrared image of a shoe on a foot. Such an image is shown in FIG. 6C. Generally, even given the great number of factors that contribute to temperature differences on the outer surfaces of a shoe, the heat generated by the foot is the main factor contributing to the temperature differences on the surface of a shoe. This main factor provides the computer processor with sufficient information to generate a computer enhanced thermal infrared image as shown in FIG. 6C. The computer enhanced thermal infrared image of FIG. 6C shows a perimeter 154 of the foot, a shoe 156, a front portion or toe box 158 of the shoe 156, a big toe 160 of the foot, and a space 162 between the front portion 158 and the front of the big toe 160. FIG. 6C further shows the back 164 of the foot, the back 166 of the shoe upper, and a space 168 between the back 164 of the foot and the back 166 of the shoe upper. FIG. 6C further shows, via computer enhanced infrared radiation, shoes laces 140, stitching 138, and the sole 134 of the shoe, as well as other parts of the shoe. Again, since gas, liquids and solids above absolute zero emit thermal infrared radiation, and since present thermographic infrared instruments are capable of seeing such radiation where such gas, liquid or solid is above a minus 35 degrees Celsius, all parts of the shoe can be ascertained by thermal infrared radiation. This method may or may not include the step of taking a thermal infrared image of a shoe having no foot therein such as shown in FIG. 6A. This method may or may not include the step of taking a thermal infrared image of a foot having no shoe thereon, such as shown in FIG. 6B. This method may or may not include the respective step or steps of taking one or more thermal infrared images from a different direction or different directions.

The Method for Determining the Proper Fit of a Shoe by the Step of Taking a Thermal Infrared Image of a Foot Having No Shoe Thereon Another method for determining the proper fit of a shoe is the step of taking a thermal infrared image of a foot having no shoe thereon. This method includes taking a thermal infrared image such as shown in FIG. 6B where the foot is preferably bare and preferably includes no sock, although this method may be practiced with a sock on the foot since the temperature differences on the outside of a sock are likely to be similar to the foot itself. For most accuracy, a person stands barefoot, or with merely socks on, in one of the thermal infrared apparatus 10, 40 or 70. If in apparatus 70, thermal infrared images are taken of both sides of each of the feet, the front end of each of the feet, the rear ends of each of the feet, the top of each of the feet and the sole of each of the feet. After the thermal infrared images of the feet are taken, the computer processor, such as from baseline information in storage, provides the person with his or her size, including length and width, for each of his or her feet. Having this information, the person may select a shoe off of the rack. This method may or may not include the step of taking a thermal infrared image of a shoe on a foot. This method may or may not include the step of taking a thermal infrared image of a shoe having no foot therein. This method may or may not include the respective step or steps of taking one or more thermal infrared images from a different direction or different directions.

The Method for Determining the Proper Fit of a Shoe by the Step of Taking a Thermal Infrared Image of a Shoe Having No Foot Therein Another method for determining the proper fit of a shoe is the step of taking a thermal infrared image of a shoe having no foot therein. This method includes the taking of a thermal infrared image of a shoe having no foot therein such as shown in FIG. 6A. By placing a shoe in one of the thermal infrared apparatus of 10, 40 or 70 and taking a thermal infrared image, the size of the shoe can be ascertained by the computer processor accessing its storage having information on a great multitude of sizes and brands. For example, a person may wear out a shoe such that the size of the shoe can not be ascertained by the tag inside of the shoe or by the printed information inside of the shoe upper or underneath the tongue. The person may not remember the exact size he or she bought. By placing the shoe in one of the thermal infrared apparatus 10, 40 or 70, the size of the shoe can be ascertained. This method may or may not include the step of taking a thermal infrared image of a shoe on a foot. This method may or may not include the step of taking a thermal infrared image of a foot having no shoe thereon. This method may or may not include the respective step or steps of taking one or more thermal infrared images from a different direction or different directions.

The Method for Determining the Proper Fit of a Shoe by the Step of Taking a First Thermal Infrared Image of a Shoe Having No Foot Therein and Taking a Second Thermal Infrared Image of the Shoe on the Foot With the computer processor 31, 62 or 124, thermal infrared images may be compared. For example, a first thermal infrared image of a shoe having no foot therein may be compared to a second thermal infrared image of a shoe on a foot. Such a comparison may be beneficial because the computer may compensate for or rule out spectrums 142, 144 and 146, shown in FIG. 6A, that have nothing to do with the heat generated by a foot. And/or the computer processor may compensate for or rule out spectrums 148, 150, and 152. Using such information, the computer may generate an image such as shown in FIG. 6C, which image may be more accurate or comprehensive or detailed than that of a thermal infrared image of merely a shoe on a foot.

This method may further include the step of taking a third infrared image of a foot having no shoe thereon. This third image may then be compared to the composite of the first and second images. Or this third image may be compared solely to the first image or solely to the second image.

This method may further include the step of superimposing, via the computer processor 31, 62, or 124, one of the first, second or third thermal infrared images upon one of the other first, second or third thermal infrared images.

This method may or may not include the respective step or steps of taking one or more thermal infrared images from a different direction or different directions.

A Method for Determininq Proper Fit of a Shoe by the Steps of Taking a First Thermal Infrared Image from a First Direction of a Shoe on a Foot and Taking a Second Thermal Infrared Image from a Second Direction of the Shoe on the Foot This method captures surfaces of the shoe hidden from one or more thermal infrared instruments and provides the computer processor with sufficient information such that the monitor 32, 64 or 126 can display a two dimensional thermal infrared image of the entire shoe and entire foot. For example, relative to thermal infrared instrument 122 which takes a top image of a shoe in location 96, the rear portion of the shoe, portions of the right and left sides of the shoe, and a great portion of the sole of the shoe are hidden from thermal infrared instrument 122. Adding even one more view to the view taken by thermal infrared instrument 122 provides a great amount of additional information.

From even one thermal infrared image, and especially when further thermal infrared images are considered by the computer processors such as the entire set of thermal infrared images 7A, 7B, 8A, 8B, 9A, and 9B for one foot, the computer processor can readily find thermal patterns, determine from the thermal patterns where the foot lies, determine from the thermal patterns where the shoe lies in relation to the foot, and determine from the thermal patterns where spaces exist between the foot and the shoe.

Other Methods for Determining Proper Fit of a Shoe by The Step of Taking a Thermal Infrared Image of a Shoe on a Foot Another method for determining proper fit of a shoe includes the step of taking a thermal infrared image of a shoe on a foot with a hand held thermal infrared instrument. Such a step may replace or complement the steps of taking one or more thermal infrared images with the thermographic infrared apparatus 10, 40 and 70.

Another method for determining proper fit of a shoe includes the step of printing, via a conventional laser jet or ink jet printer or other printer having a toner or conventional ink, a thermal infrared image of a shoe on a foot. Such a step may replace or complement a thermal infrared image on a monitor.

Incorporation by Reference

As to the thermographic infrared instruments of thermographic infrared apparatus 10, including thermographic infrared instruments 26 and 28, as to the thermographic infrared instruments of thermographic infrared apparatus 40 including thermographic instruments 52, 54, 56, and 58, and as to the thermographic infrared instruments 100, 102, 104, 106, 108, 110, 112, 114, 116, 118, 120, and 122, the following patents are hereby incorporated by reference in their entireties: 1) the Carlson U.S. Pat. No. 4,642,454 issued Feb. 10, 1987 and entitled Infrared Intrusion Detector With Field Of View Locator; 2) the Heinke et al. U.S. Pat. No. 5,815,410 issued Sep. 29, 1998 and entitled Ratio Type Infrared Thermometer; 3) the Stewart U.S. Pat. No. 6,507,024 issued Jan. 14, 2003 and entitled Low Cost Infrared Camera; and 4) the Wood et al. U.S. Pat. No. 5,675,149 issued Oct. 7, 19971 and entitled Compact Thermal Camera. From such references, especially, the Stewart and Wood et al. references, it can be noted that the thermographic infrared instruments of thermographic infrared apparatus 10, 40 and 70 can be relatively compact, can provide digital infrared image information, can include focal plane array electronics, can be relatively inexpensive, and can capture thermal infrared radiation having a wavelength from eight to twelve micrometers.

As to the computer processor 31, 62 and 124 and its hardware and software, the following patents are hereby incorporated by reference in their entireties: 1) the Ejiri et al. U.S. Pat. No. 6,104,840 issued Aug. 15, 2000 and entitled Method And System For Generating A Composite Image From Partially Overlapping Adjacent Images Taken Along A Plurality Of Axes; 2) the Parulski et al. U.S. Pat. No. 6,366,316 issued Apr. 2, 2002 and entitled Electronic Imaging System For Generating A Composite Image Using The Difference Of Two Images; and 3) the Stephan et al. U.S. Pat. No. 6,362,832 issued Mar. 26, 2002 and entitled Method And System For Overlaying At Least Three Microarray Images To Obtain A Multicolor Composite Image.

Exploiting Temperature Differences on the Outside of the Shoe

A foot generates heat that in turn warms up inner surfaces of a shoe that in turn warms up the outer surfaces of the shoe. Spaces within a shoe will not warm up inner surfaces of the shoe such that corresponding outer surfaces will not warm up. The present invention, therefore, exploits the temperature differences on the outside of a shoe.

Such temperature differences may be measured by infrared thermography or by other means. Means of measuring the temperature of outer surfaces of a shoe include 1) directly contacting one or more outer surfaces of a shoe and measuring the differences in temperature with bulb thermometers, bimetallic strip thermometers, thermoresistors or thermisters or other direct contact apparatus and 2) not contacting any of the outer surfaces of the shoe and measuring the temperature of the outer surfaces of the shoe by, for example, interferometry such as holographic interferometry or point diffraction interferometry, and infrared thermography. Infrared thermography is the preferred means of measuring the temperature differences of the outer surfaces of a shoe.

With the method of directly contacting the shoe or with the method of not contacting the shoe, the present invention includes the steps of finding temperature differences on an outer surface of a shoe and correlating said temperature differences with foot position inside of the shoe.

Figure 10:
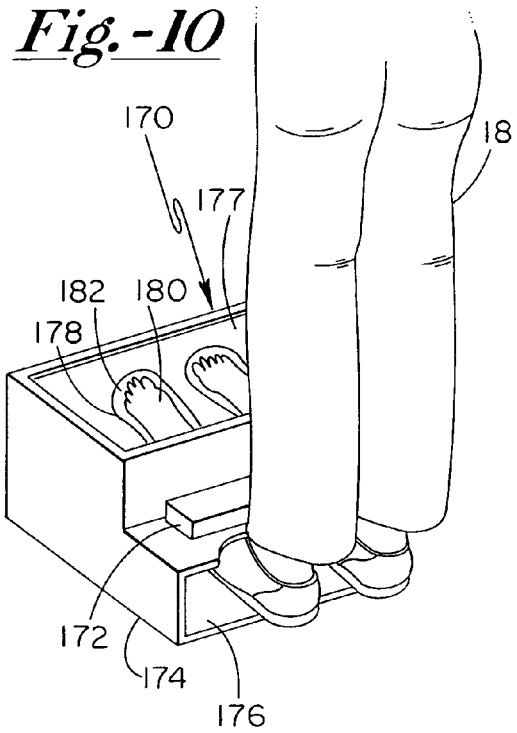
FIG. 10 is a diagrammatic view of a low dose x-ray apparatus of the present invention for determining the proper fit of a shoe.

Low Dose Penetrating X-Ray Radiation Apparatus and Method for Determining the Proper Fit of a Shoe on a Foot The present invention further includes a low dose x-ray radiation apparatus and method for determining the proper fit of a shoe on a foot by perceiving the foot inside of the shoe. More specifically, as shown in FIG. 10, an x-ray apparatus 170 includes an x-ray source 172 having a voltage generator, and a detector housing 174 having one or more of a storage luminescent screen, scanner, detector, detector arrays such as linear arrays that require scanning or area arrays or large area arrays that require no scanning and have rows and columns of pixels. Fluorescent screens provide real-time imaging.

The x-ray apparatus 170 is preferably a digital x-ray imager. Digital x-ray imaging is highly sensitive, thereby decreasing the amount of radiation delivered or the amount of time over which the radiation is delivered. The most common sensor or detector is the silicon based charge coupled device, though materials such as gallium arsenide, cadmium telluride and cadmium zinc telluride are even more sensitive than silicon, thereby even further reducing the amount of radiation delivered or the amount of time over which the radiation is delivered.

The low dose x-ray apparatus 170 includes a base 176, as part of the housing 174, and having a location upon which at least a portion of a shoe is placed; the low dose x-ray source 172 aimable at the base; a detector for detecting x-rays emitted by the source; and a display 178 aimable at a person wearing the shoe on the base 176 and being in communication with the detector. A person wearing the shoe can wiggle her foot to watch, via the display 177, movement of her foot inside of the shoe.

The dose of radiation emitted by the x-ray source 174 may be measured by the time that it takes to get the same dose of radiation from nature (or background equivalent radiation time (BERT)). Preferably, the dose of radiation emitted by the x-ray source 174 emits most preferably less radiation than that naturally received by a person in Key Largo, Fla., over about seven days time.

The dose of radiation emitted by the x-ray source 174 may be measured in millirems. The dose of radiation emitted by the x-ray source is preferably less than or equal to about 52 millirems (the amount for a cervical spine x-ray), more preferably less than 21 millirems (the amount for a femur x-ray), even more preferably less than or equal to about 9 millirems (the amount for a full mouth series of x-rays, i.e., 18 films), and most preferably less than or equal to about 0.5 millirems (the amount for one dental x-ray).

In or about 1999, the U.S. government allowed workers exposed to radiation on the job to be exposed to no more than 5000 millirems per year.

Imaging by the low dose x-ray apparatus 170 may show an image 178 of a perimeter of the shoe upper of a left shoe, an image 180 of the left foot of the person 18, and an image 182 of spaces between perimeter of the shoe upper and the left foot. Such imaging also shows images of the right shoe, right foot, and spaces therebetween.

As to the low dose x-ray apparatus 170, the following patents are hereby incorporated by reference in their entireties: 1) the Fuchs et al. U.S. Pat. No. 6,477,230 issued Nov. 5, 2002 and entitled X-ray Diagnostic Installation With Electronic Zoom For A Detector With A Storage Luminescent Screen; 2) the Grodzins et al. U.S. Pat. No. 6,459,761 issued Oct. 1, 2002 and entitled Spectrally Shaped X-ray Inspection System that discloses both penetrating x-rays and Z back scattering x-rays apparatus; and 3) the Schmitt et al. U.S. Pat. No. 6,497,511 issued Dec. 24, 2002 and entitled Method And Device For Imaging In Digital Dental Radioscopy.

Figure 11:
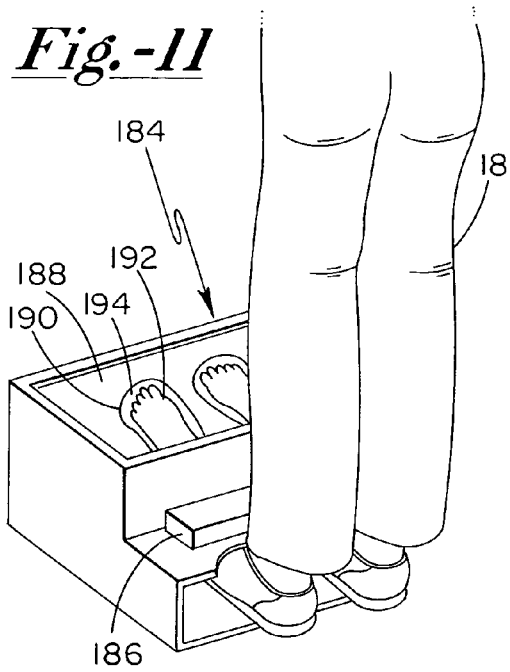
FIG. 11 is a diagrammatic view of a back scattering x-ray apparatus of the present invention for determining the proper fit of a shoe.

Backscatterinq X-Ray Radiation Apparatus and Method for Determining the Proper Fit of a Shoe on a Foot As shown in FIG. 11, a backscattering x-ray imaging apparatus 184 penetrates clothing and shoes such as leather and synthetic shoes, but may not penetrate the body. The backscattering x-ray imaging apparatus 184 has a housing 186 that includes both an x-ray source and a back scattering detector. The back scattering detector converts the backscattered radiation into electrical signals that may show on a monitor 188 an image 190 of a perimeter of the shoe upper of a left shoe, an image 192 of the left foot of the person 18, and an image 194 of spaces between perimeter of the shoe upper and the left foot. Such imaging also shows images of the right shoe, right foot, and spaces therebetween.

As to the back scattering x-ray imaging apparatus 184, the following patents are hereby incorporated by reference in their entireties: 1) the Rothschild U.S. Patent No. 5,642,394 issued Jun. 24, 1997 and entitled Sidescatter X-ray Detection System; 2) the Grodzins U.S. Pat. No. 6,282,260 issued Aug. 28, 2001 and entitled Unilateral Hand-Held X-ray Inspection Apparatus; and 3) the Grodzins et al. U.S. Pat. No. 6,459,761 issued Oct. 1, 2002 and entitled Spectrally Shaped X-ray Inspection System.

Figure 12:
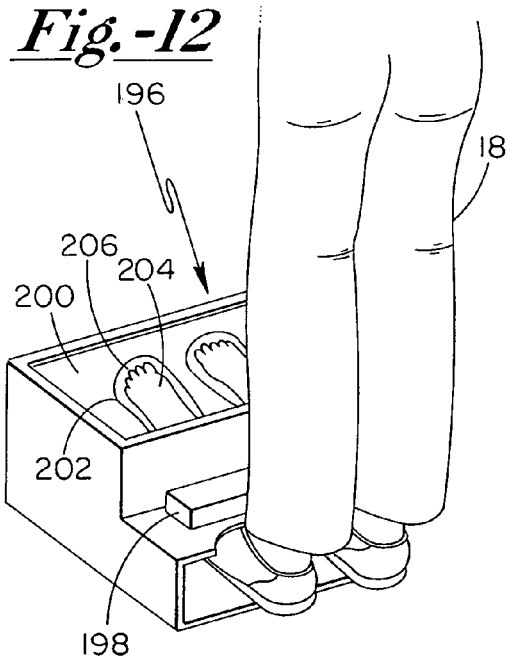
FIG. 12 is a diagrammatic view of a wave imaging apparatus of the present invention for determining the proper fit of a shoe where the wave may be a microwave, sound wave, or radio wave less than the frequency of microwaves.

Wave Imaging Apparatus and Method for Determining the Proper fit of a shoe on a foot, including microwave, Acoustic and Radio Wave Imaging As shown in FIG. 12, a wave imaging apparatus 196 includes a housing 198 that includes a source of wave energy, an antenna, a parabolic reflector, a table rotatable around the parabolic reflector, a laser, a modulator, an etalon, and a video camera. The wave antenna receives wave energy reflected from the shoe upper and the foot inside of the shoe. Such collected radiation is then used to modulate an optical beam such as a laser beam. The modulated beam is then analyzed by an optical spectrum analyzer to produce an image of objects in the field of view. The wave energy may be microwave energy, acoustic (sound) wave energy, or radio wave energy at a frequency lower than microwaves.

The wave imaging apparatus 196 is capable of real time imaging and imaging through objects such as leather, synthetic materials, shoe uppers, and wooden shoes such as clogs to show on a monitor 200 an image 202 of a perimeter of the shoe upper of a left shoe, an image 204 of the left foot of the person 18, and an image 206 of spaces between perimeter of the shoe upper and the left foot. Such imaging also shows images of the right shoe, right foot, and spaces therebetween.

As to the wave imaging apparatus 196, the following patent is hereby incorporated by reference in its entirety: the Johnson et al. U.S. Pat. No. 5,365,237 issued Nov. 15, 1994 that discloses microwave, acoustic, radio and light wave imaging.

Figure 13:
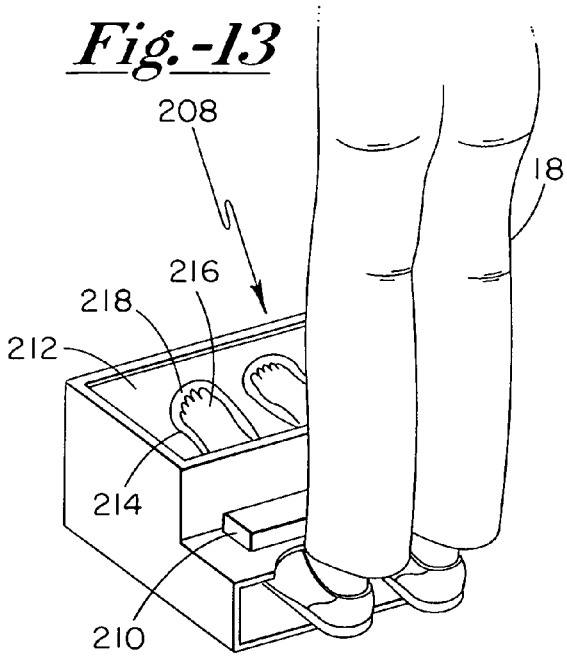
FIG. 13 is a diagrammatic view of an ultrasound imaging apparatus of the present invention for determining the proper fit of a shoe.

Ultrasound Imaging Apparatus and Method for Determining the Proper Fit of a Shoe on a Foot As shown in FIG. 13, an ultrasound imaging apparatus 208 includes a housing 210 having an ultrasound probe that may be automatically run over the surface of a shoe upper preferably without gel or any other intervening substance, an input for receiving ultrasound signals provided by the ultrasound probe, a processor for processing the ultrasound signals for producing an output of three-dimensional imaging signals such that a monitor shows an image 214 of a perimeter of the shoe upper of a left shoe, an image 216 of the left foot of the person 18, and an image 218 of spaces between perimeter of the shoe upper and the left foot. Such imaging also shows images of the right shoe, right foot, and spaces therebetween.

As to the ultrasound imaging apparatus 208, the following patent is hereby incorporated by reference in its entirety: the Fenster et al. U.S. Pat. No. 6,461,298 issued Oct. 8, 2002 and entitled Three-Dimensional Imaging System.

Placement of the Shoe in the Apparatus

Figure 8A:
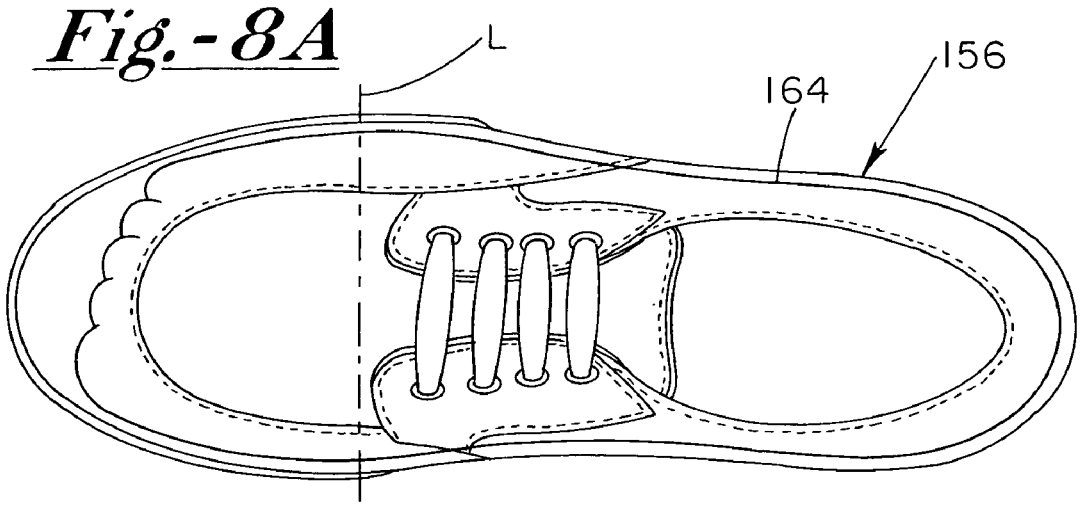
FIG. 8A is a thermographic infrared computer enhanced image of the top side of the right shoe on the right foot of FIG. 7A, where the image was captured by the thermographic infrared apparatus of FIG. 3.
Figure 8B:
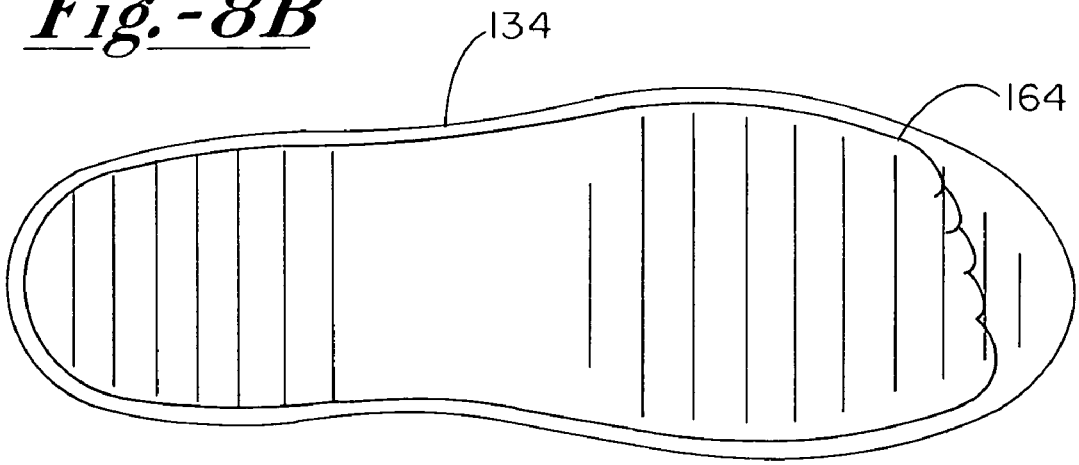
FIG. 8B is a thermographic infrared computer enhanced image of the sole of the right shoe on the right foot of FIG. 7A, where the image was captured by the thermographic infrared apparatus of FIG. 3.

It should be noted that the shoe having the foot therein may be placed wholly or part of the way such as one-half of the way in the selected apparatus of FIGS. 1–2 and 10–13. Preferably, the shoe from somewhere in the instep (i.e., the portion of the shoe corresponding to the back, middle or front of the arch of the foot) to the front tip of the shoe is placed in the selected apparatus. Most preferably, only that front portion of the shoe having the toes (such as the portion of the shoe corresponding to somewhere along the ball of the foot to beyond the front tip of the big toe) is placed in the apparatus so as to reduce exposure to x-ray radiation and/or so as to minimize computer processing and imaging time. In both placements, the heel of the shoe is kept outside of the apparatus. For example, FIG. 8A shows a line L. The part of the shoe and foot frontwardly of the line L may be the only part of the shoe and foot that is placed in the apparatus of the present invention.

What is claimed is:

1. A method for determining proper fit of a shoe, comprising the step of taking a thermal infrared electronic image of at least an outside portion of a shoe having a foot therein, and further comprising the steps of finding thermal patterns in the thermal infrared electronic image, determining from said thermal patterns where the foot lies, determining from said thermal patterns where the shoe lies in relation to the foot, and determining from said thermal patterns where spaces exist between the foot and the shoe.

2. A method for determining proper fit of a shoe, comprising the steps of:

taking a first thermal infrared image of at least a portion of a shoe having no foot therein;

taking a second thermal infrared image of at least an outside portion of the shoe having a foot therein; and comparing the first and second thermal infrared images;

wherein each of the first and second thermal infrared images are electronic images.

3. The method of claim 2, and further comprising the step of taking a third thermal infrared image of at least a portion of the foot having no shoe thereon and comparing the first, second and third thermal infrared images.

4. The method of claim 2, wherein the step of comparing the first and second thermal infrared images comprises the step of superimposing one of the images upon the other of the images.

5. A method for determining proper fit of a shoe, comprising the steps of: taking a first thermal infrared image from a first direction of at least a portion of a shoe having a foot therein and taking a second thermal infrared image from a second direction of at least an outside portion of the shoe having a foot therein to capture surfaces of the shoe hidden from the first thermal infrared image, wherein each of the first and second thermal infrared images are electronic images.

6. The method of claim 5 and further comprising the step of forming a two dimensional image from the first thermal infrared image and from the second thermal infrared image and then displaying the two dimensional image.

7. The method of claim 5 and further comprising the steps of finding thermal patterns on the first and second thermal infrared images, determining from said thermal patterns where the foot lies, determining from said thermal patterns where the shoe lies in relation to the foot, and determining from said thermal patterns where spaces exist between the foot and the shoe.

8. The method of claim 5 and further comprising the step of selecting one of the thermal infrared images to be taken from a direction relative to a sole of a shoe so as to capture a thermal infrared image of the sole of the shoe.

9. A thermal infrared apparatus for the perception of a foot inside of a shoe for determining proper fit of the shoe, comprising:

a) a base having a location upon which the shoe is placed;

b) a thermal infrared instrument aimable at the base, wherein the thermal infrared instrument is capable of detecting thermal patterns on an outside surface of the shoe, wherein the thermal infrared instrument is a camera instrument; and c) a display aimable at a person wearing the shoe on the base, wherein the display is in communication with the thermal instrument and is capable of displaying said thermal patterns;

d) whereby a person wearing the shoe can wiggle her foot to watch, via changing thermal patterns on the display, movement of her foot inside of the shoe.

10. The thermal infrared apparatus of claim 9, wherein the thermal infrared instrument comprises two fields of view, wherein one of the fields of view captures a view of at least a portion of the foot from one direction, wherein the other of the fields of view captures a view of at least a portion of the foot from another direction, whereby surfaces hidden from one of the views may be captured by the other of the views.

11. The thermal infrared apparatus of claim 9, wherein the display comprises two fields of view, wherein one of the fields of view displays a view of at least a portion of the foot from one direction, wherein the other of the fields of view displays a view of at least a portion of the foot from another direction, whereby surfaces hidden in one of the views may be displayed in the other of the views.

12. The thermal infrared apparatus of claim 9, wherein the base defines a right location for a right shoe and wherein the base defines a left location for a left shoe, and wherein the thermal infrared instrument includes a field of view that captures a thermal image of at least a portion of both of the right and left shoes at the same time when the right and left shoes are at the right and left locations.

13. The thermal infrared apparatus of claim 9, wherein the thermal infrared instrument comprises a field of view, wherein the base comprises a front surface and a rear surface opposite of the front surface, wherein the field of view is directed at the front surface at said location such that a top view of at least a portion of the shoe is captured.

14. The thermal infrared apparatus of claim 9, wherein the thermal infrared instrument comprises a field of view, wherein the base comprises a front surface and a rear surface opposite of the front surface, wherein the field of view is directed at the rear surface at said location such that a bottom view of at least a portion of the shoe is captured.

15. The thermal infrared apparatus of claim 9, wherein the base is apertured at said location such that thermal infrared radiation can radiate through apertures in the base and be captured by said thermal infrared instrument.

16. The thermal infrared apparatus of claim 9, wherein the thermal infrared instrument comprises a field of view, wherein the base comprises a front surface and a rear surface opposite of the front surface, wherein the field of view is directed generally parallel to the front surface and generally laterally over said location such that a side view of at least a portion of the shoe is captured.

17. The thermal infrared apparatus of claim 9, wherein the thermal infrared instrument comprises a field of view, wherein the base comprises a front surface and a rear surface opposite of the front surface, wherein the field of view is directed generally parallel to the front surface and generally longitudinally over said location such that an end view of at least a portion of the shoe is captured.

18. A method for determining proper fit of a shoe, comprising the steps of finding temperature differences on an outer surface of a shoe and correlating said temperature differences with foot position inside of the shoe, wherein said step of correlating said temperature differences with foot position inside of the shoe comprises the steps of finding thermal patterns in said temperature differences, determining from said thermal patterns where the foot lies, determining from said thermal patterns where the shoe lies in relation to the foot, and determining from said thermal patterns where spaces exist between the foot and the shoe such that said temperature differences are correlated with foot position inside of the shoe.

19. The method of claim 18 wherein the step of finding temperature differences on an outer surface of the shoe comprises the step of taking a temperature of a portion of said outer surface of the shoe by not contacting said portion of said outer surface with an apparatus that determines temperature without contact.

20. A method for determining proper fit of a shoe, comprising the steps of:

a) perceiving a position of a foot inside of a shoe and taking an image of the position perceived;

b) digitally processing the image; and c) showing the image that has been digitally processed on a monitor.

21. The method of claim 20 wherein the step of perceiving a position of a foot inside of a shoe comprises the step of perceiving a position of a foot inside of a shoe without making contact with the shoe.

22. The method of claim 20 wherein the step of perceiving a position of a foot inside of a shoe comprises the step of determining temperature differences on an outside of the shoe.

23. The method of claim 20 wherein the step of perceiving a position of a foot inside of a shoe comprises the step of taking an infrared thermographic image of the shoe having the foot therein.

* * * * *